United States Patent [19]

Nakano et al.

[11] 4,278,021

[45] Jul. 14, 1981

[54] MAGNETIC INTERFERENCE PREVENTION SYSTEM

[75] Inventors: Hiroshige Nakano; Shigenobu Katagiri; Shinichi Nishino, all of Katsuta, Japan

[73] Assignee: Hitachi Koki Company, Limited, Tokyo, Japan

[21] Appl. No.: 69,131

[22] Filed: Aug. 23, 1979

[30] Foreign Application Priority Data

Apr. 13, 1979 [JP] Japan ..... 54/45803
May 7, 1979 [JP] Japan ..... 54/56192

[51] Int. Cl.[3] ..... B41J 9/38

[52] U.S. Cl. ..... 101/93.29; 101/93.14; 101/93.03; 361/191

[58] Field of Search ..... 101/93.02, 93.03, 93.29, 101/93.34, 93.48, 93.09, 93.14; 361/159, 166, 167, 191, 192, 193

[56] References Cited

U.S. PATENT DOCUMENTS

| | | | |
|---|---|---|---|
| 3,633,496 | 1/1972 | Kearns | 361/191 X |
| 3,855,923 | 12/1974 | Foley | 101/93.29 |
| 3,899,968 | 8/1975 | McDevitt | 101/93.14 X |
| 3,952,648 | 4/1976 | Sery et al. | 101/93.14 |

OTHER PUBLICATIONS

Blythe et al., IBM Tech. Discl. Bulletin, vol. 20, No. 4, Sep. 1977, pp. 1319–1320.

Gregory et al., IBM Tech. Discl. Bulletin, vol. 20, No. 1, Jun. 1977, pp. 90–95.

*Primary Examiner*—Edward M. Coven

*Attorney, Agent, or Firm*—Sughrue, Rothwell, Mion, Zinn and Macpeak

[57] ABSTRACT

A printing device having a plurality of print hammers having striking surfaces arranged along a print line and print magnets provided adjacent to one another for driving the printing hammers. A magnetic interference preventing device comprises a memory for storing for each column the excitation lapse time information of the print magnets. A reader which, when exciting each print magnet is started, reads the excitation lapse time information of both print magnets adjacent to each print magnet out of the memory. The reader outputs a signal only when the excitation lapse times of both print magnets are in a predetermined range of time. An inhibitor is used for inhibiting the excitation of each print magnet when the excitation lapse times of both print magnets are within the predetermined range of time.

16 Claims, 8 Drawing Figures

MAGNETIC INTERFERENCE PREVENTION SYSTEM

BACKGROUND OF THE INVENTION

This invention relates to printing devices such as line printers. More particularly it relates to a magnetic interference preventing device in such a printing device, which is suitable for preventing the mutual magnetic interference of print magnets which are provided adjacent to one another to excite the respective print hammers.

In an impact type printing device comprising a number of print hammers arranged along a print line (position) and print magnets for exciting the print hammers, the print magnets are, in general, arranged extremely close to one another. This is to minimize space, and is shown in FIG. 1.

As is apparent from FIG. 1, when one of adjacent print magnets 2 is excited, any leakage flux thereof will be passed through the magnetic paths of the print magnets 2 adjacent thereto. Accordingly, adjacent print magnets which should not be excited are excited. In FIG. 1, reference numeral 1 designates the striking surfaces of the print hammers.

Printing a type in a column is carried out in accordance with a method in which the print magnet 2 is excited. It drives the print hammer by taking into account the flight time of the print hammer which is required for the print hammer to move from its rest position to the type striking position.

If, before a print hammer at a column is driven, a print magnet 2 adjacent thereto has been excited, then the energy supplied to the print hammer becomes different because the initial magnetic flux $\phi_O$ of the print magnet is not zero. As a result, the flight time is changed, printing the type at the correct position does not result and, in a worst case the type may not be printed.

In order to eliminate this difficulty, a method has been proposed in which a magnetic flux shielding plate is provided between the print magnets to prevent the magnetic interference of the print magnets 2.

However, the provision of the magnetic flux shielding plate makes the structure of the print hammer module intricate, and is one of the contributing causes which increase the manufacturing cost. Recently, there has been a strong demand for miniaturizing a printing device and accordingly its print hammers. If the size of the printing device is reduced, then it may be impossible to provide the magnetic flux shielding plates therein. Furthermore, even if the magnetic flux shielding plates could be provided in the printing device, the effect thereof would be insufficient. That is, it would be difficult to sufficiently prevent the magnetic interference of the print magnets.

The effect of the magnetic interference is most significant when both print magnets adjacent to, or on both sides of, a print magnet which is to be excited are being excited. More specifically, if, when the (N−2)-th column print magnet and the (N+2)-th column print magnet are being excited, the N-th column print magnet is also excited, then the effect of the magnetic interference is at a maximum.

SUMMARY OF THE INVENTION

Accordingly, an object of this invention is to eliminate the above-described difficulties accompanying a prior art printer, and to prevent the magnetic interference without causing a significant decrease in the printing speed.

It is another object of this invention to provide a system for driving print magnets in a manner eliminating magnetic interference.

Still another object of this invention is to provide a system for driving print magnets which reduces the size and cost of the print hammer module thereby reducing the overall size of the system.

This invention has been developed on the realization that, even when both print magnets adjacent to a concerned print magnet are being excited, the effect of the magnetic interference depends on the excitation lapse times of both print magnets. Thus, one specific feature of the invention resides in that the excitation lapse times of the both print magnets are detected, so that only when the excitation lapse times are within a predetermined range of time, the excitation of the concerned print magnet is inhibited. According to the invention, the only decrease in the printing speed is inconsequential.

Another specific feature of the present invention resides in that when adjacent print magnets are excited, excitement of a print magnet which is affected by the leakage flux thereof is inhibited until the effect of the leakage flux is reduced to a negligible extent.

It is assumed that print hammers corresponding to the adjacent print hammers are provided for (N−2)-th, N-th and (N+2)-th columns, respectively. The magnetic interference is maximum in the case where the N-th column print magnet is excited to drive the print hammer during the period in which both of the (N−2)-th and (N+2)-th column print magnets are excited. Accordingly, excitement of the N-th column print magnet should be inhibited for this period.

In order to inhibit exciting the N-th column print magnet, a flag memory for indicating whether or not a print magnet for each column is excited is added to a buffer memory in which printing data codes for all of the columns are stored (hereinafter referred to as "a PLB"). The contents of the flag memory for the (N−2)-th column and the (N+2)-th column are checked before the N-th column print magnet is excited, and when both are being excited, then excitement of the N-th column print magnet is inhibited.

According to this method, the magnetic interference caused by the excitement of adjacent print magnets can be positively prevented, and accordingly the print position shift can be prevented.

This invention will be described with reference to the preferred embodiments as described in the accompanying drawings and discussed in detail herein.

DESCRIPTION OF THE PREFERRED EMBODIMENTS

Figure 1:
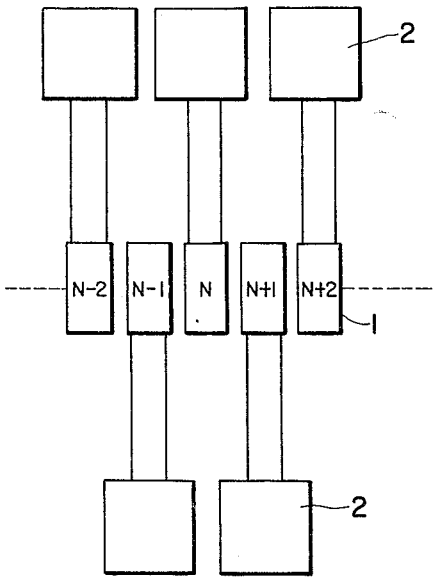
FIG. 1 is a front view showing the arrangement of print hammer striking surfaces and print magnets.

The arrangement of the print hammer striking surfaces and the print magnets 2 thereof is as shown in FIG. 1.

Figure 2:
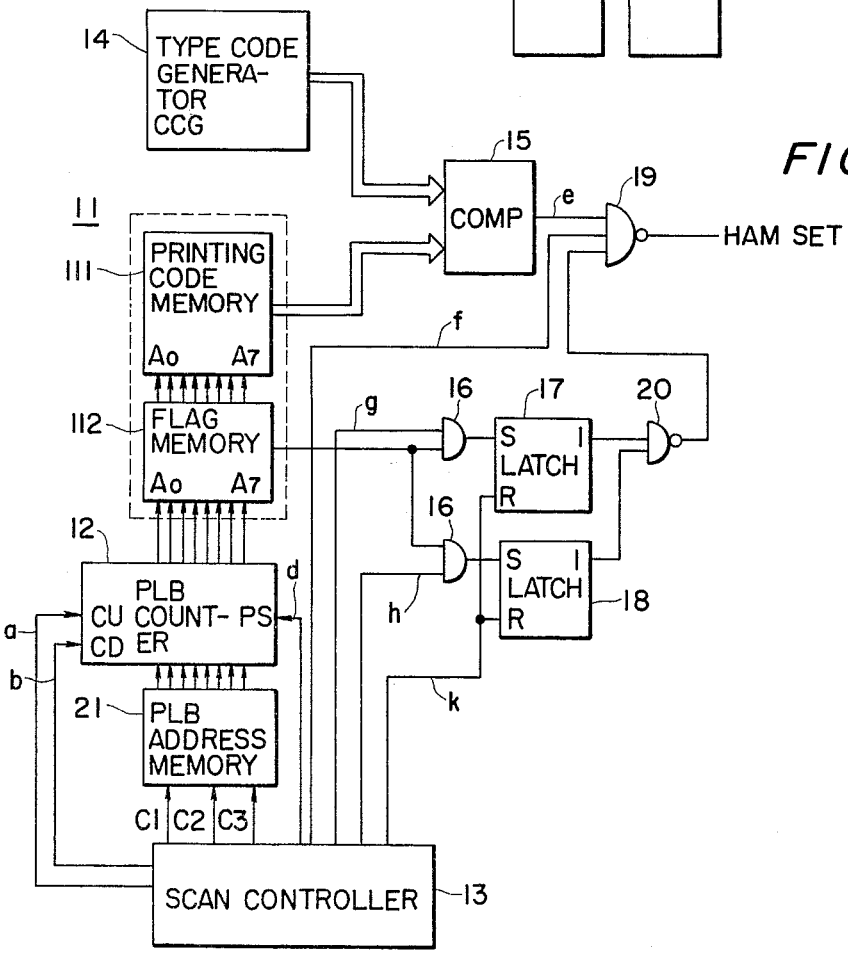
FIG. 2 is a diagram showing one embodiment of a magnetic interference preventing device in a printing device according to this invention.

In such a printing device, as is well known in the art, printing data codes for one line to be printed by the above-described print hammers are received from a data source such as a CPU (central processing unit) and stored in the above-described PLB 11, as shown in FIG. 2. During a printing cycle, whenever a type on a type carrier (not shown) is moved by one pitch, the PLB 11 is scanned so that the code of a type confronting a print hammer is compared with the code of a character to be printed. When the two codes coincide with each other as a result of the comparison, the print hammer of that column is driven to print the character.

For convenience in description, the method of scanning the PLB 11 will be described with reference to a band printer in which during one main scan, i.e., whenever a type is moved by one pitch, sub-scan is carried out five times.

In a printing device carrying out the sub-scan five times, the columns of print hammers driven in each sub-scan are as listed below: In this connection, 132 columns are provided for one line.

Sub-scan 1—1st, 6th, 11th, 16th . . . 126th and 131st columns

Sub-scan 2—2nd, 7th, 12th, 17th . . . 127th and 132nd columns

Sub-scan 3—3rd, 8th, 13th, 18th . . . 128th columns

Sub-scan 4—4th, 9th, 14th, 19th . . . 129th columns

Sub-scan 5–5th, 10th, 15th, 20th . . . 130th columns

In the sub-scan 1, the PLB 11 is scanned in the order of 1st, 6th . . . and 131st columns. Each printing data code is outputted by the PLB, and the codes of types confronting respectively with the print hammers of the columns are outputted by a type code generator 14 (hereinafter referred to as "a CCG 14"). The printing data codes and type codes are subjected to comparison in a comparator 15. Before the comparison is carried out to drive a print hammer, detection is carried out as to whether the print magnets 2 on both sides of the relevant column have been excited or not.

This detection method will now be described. In the PLB 11, in addition to a printing data code memory region 111, a flag memory 112 is provided which stores a logic value "1" (hereinafter referred to as "1") while each print hammer and accordingly each print magnet 2 is being excited and stores a logic value "0" (hereinafter referred to as "0") while it is not driven. Accordingly, when the printing data code of each column is received from the data source, "0" is written into all of the columns of the flag memory 112.

When the sub-scan 1 is started in the printing cycle, the 1st column print hammer can be driven first. The 3rd column and the −1st column (which does not exist and is a phantom column) are next to the column of the 1st column print magnet 2. Thus, it is detected whether or not these columns' print magnets 2 are being excited. When a memory scan is started in the sub-scan 1, the top address (−1st column) of the sub-scan 1 in a PLB address memory 21 is specified by a signal $C_1$, $C_2$, $C_3$ indicating the sub-scan number, and a PLB counter 12 specifies the −1st column with the aid of a preset signal d. The output of the PLB 11 for this column is ineffective but scans the PLB 11.

Thereafter, four count-up clock pulses a are outputted by a scan controller 13. As a result, the content of the PLB counter 12 is increased by four counts and the 3rd column is specified. Since the 3rd column of the flag memory 112 is "0", a latch 18 is maintained reset, and the output of the latch 18 is "0". Thereafter, the scan controller 13 outputs two count-down clock pulses b. As a result, the content of the PLB counter 12 is decreased by two counts, and the 1st column is specified. The PLB 11 outputs a printing data code for the 1st column, and the printing data code is applied to a comparator 15. The code of a type confronting with the 1st column print hammer is outputted by the CCG 14 and is applied to the comparator 15.

When the printing data code coincides with the type code, then the output e of the comparator 15 is set to "1". In this case, the outputs of a latch 17 and the latch 18 are "0", that is, the adjacent print magnets 2 are not being excited. Therefore, the output of a NAND gate 20 is "1". If, when the output of the comparator 15 is "1", a hammer firing signal f is provided, then a NAND gate 19 is opened to output a signal HAMSET. As a result, the 1st column print hammer is driven by a drive circuit and a print magnet (not shown).

The 6th column print magnet can be excited next. The columns of the print magnets adjacent thereto are the 4th and 8th columns. In order to detect whether or not these adjacent print magnets are excited, three count-up clock pulses a are outputted by the scan controller 13. As a result, the content of the PLB counter 12 is increased by three counts, and the 4th column is specified. In this operation, the latches 17 and 18 are reset by a signal k from the scan controller 13. Because the 4th column of the flag memory 112 is "0", the latch 17 is maintained reset and the output of the latch 17 is "0". Thereafter, four count-up clock pulses a are outputted by the scan controller 13 and the content of the PLB counter 12 is increased by four counts. Hence the 8th column is specified. As the 8th column of the flag memory 112 is "0", the latch 18 is maintained reset.

Thereafter, two count-down clock pulses b are provided by the scan controller 13, the content of the PLB counter 12 is decreased by two counts, and the 6th column is specified. The printing data code for the 6th column is provided by the PLB 11 and is applied to the comparator 15. The code of a type confronting with the 6th column print hammer is outputted by the CCG 14, and is applied to the comparator 15. When the printing data code coincides with the type code, then the output e of the comparator 15 is raised to "1". In this case, the output of the NAND gate 20 is "1". Therefore, if the output of the comparator 15 is "1", the signal HAMSET is set to "0", and the 6th column print hammer is driven.

Similarly, the information in the flag memory 112 of the PLB with respect to the −2nd and +2nd columns from the column of a print hammer which can be driven in the sub-scan 1 is detected. When the information in the flag memory 112 is "1", the latches 17 and 18 are set. However, when the information in the flag memory 112 is "0", the latches 17 and 18 are maintained reset. The printing data code for the column of the print hammer is applied from the PLB 11 to the comparator 15, where it is compared with the respective type code.

When the sub-scan 2 is started after the completion of the sub-scan 1, the PLB counter 12 presets the top address of the sub-scan 2 in the PLB address memory 21 and specifies the 0-th column (which does not exist and is a phantom column). The output of the PLB 11 for this column is ineffective but scans the PLB 11. Thereafter, four count-up clock pulses a are provided by the scan controller 13 and as a result, the content of the PLB counter 12 is increased by four counts and the 4th column is specified. Since the 4th column of the flag memory 112 is "0", the latch 18 is maintained reset, and the output of the latch 18 is "0". Then, two count-down clock pulses b are outputted by the scan controller 13. Consequently the content of the PLB counter 12 is decreased by two counts and the 2nd column is specified. A printing data code for the 2nd column is applied from the PLB 11 to the comparator 15.

On the other hand, the code of a type confronting the 2nd column print hammer is outputted by the CCG 14, and it is applied to the comparator 15. When the two codes are coincident with each other, the output e of the comparator 15 is set to "1". The output of the NAND gate 20 is "1" and therefore the signal HAMSET is set to "0". Hence, the 2nd column print hammer is driven.

Thereafter, similarly as in the sequence of the sub-scan 1, the information in the flag memory 112 of the PLB with respect to the −2nd and +2nd columns from the column of a print hammer which can be driven in the sub-scan 2 is detected. When the information in the flag memory 112 is "1", then the latches 17 and 18 are set, whereas if the information is "0", then the latches 17 and 18 are maintained reset. Thereafter, the printing data code for the column of the print hammer is applied from the PLB 11 to the comparator 15, where it is compared with the type code.

When the sub-scans 3, 4 and 5 are started, the PLB counter 12 specifies the 1st, 2nd and 3rd columns with the aid of the PLB address memory 21, respectively. Thereafter, as in the above-described sequence, the information in the flag memory 112 with respect to the −2nd and +2nd columns from the column of a print hammer which can be driven in each subscan is detected. When the information in the flag memory 112 is "1", then the latches 17 and 18 are set. However, if the information is "0", then the latches 17 and 18 are maintained reset. Thereafter, the printing data code for the column of the print hammer from the PLB 11 is compared with the respective type code in the comparator 15.

Figure 3:
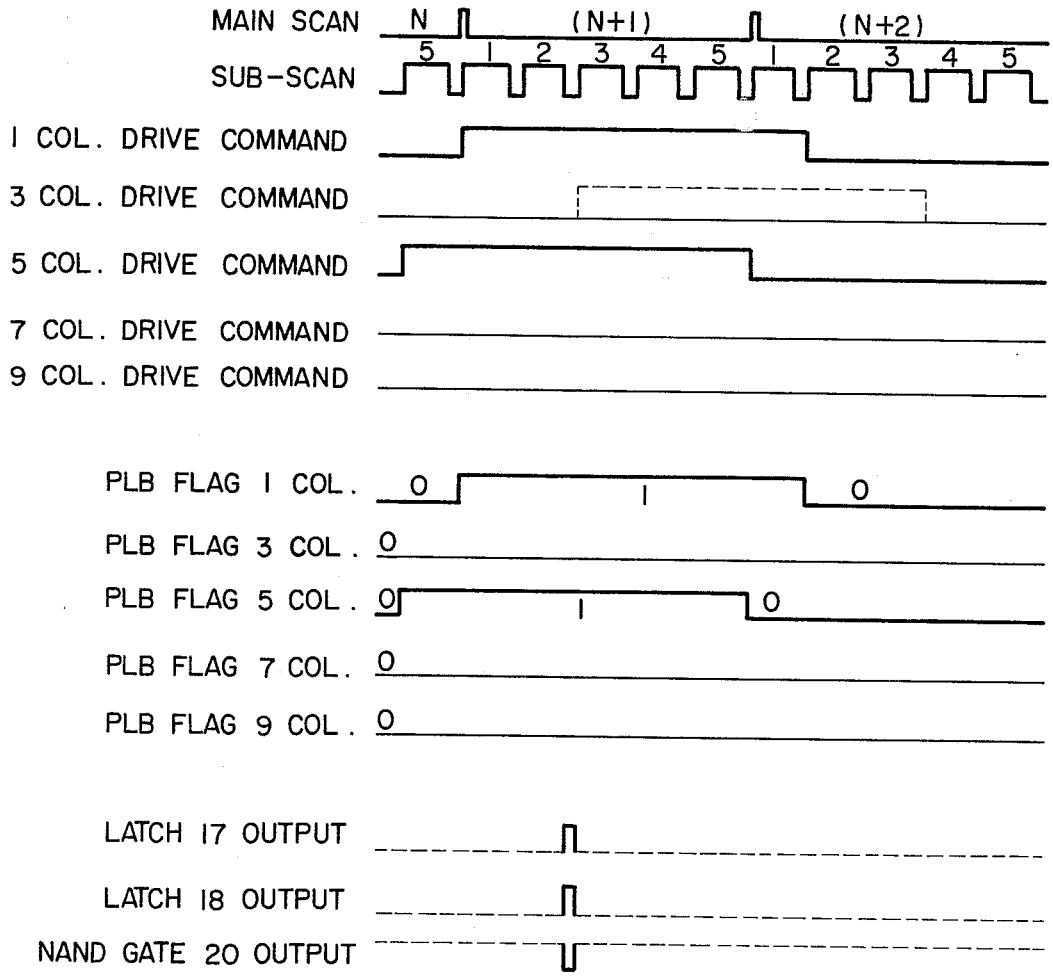
FIG. 3 is a timing diagram for a description of the operation of the device shown in FIG. 2.

The case where the device according to the invention becomes effective will be described with reference to FIG. 3.

It is assumed that in the sub-scan 5 of the N-th main scan, the 5th column print hammer is driven. In this operation, "1" is written into the 5th column of the flag memory 112. Furthermore, it is assumed that at this time none of the 1st, 3rd, 7th and 9th print hammers are driven.

In the sub-scan 1 of the (N+1)-th main scan, the 1st print hammer is driven and "1" is written into the 1st column of the flag memory 112.

In driving the 7th column print hammer in the sub-scan 2 of the same main scan, first the 5th column of the flag memory 112 is "1", therefore the latch 17 is set, and the output of the latch 17 is set to "1". Next, the 9th column of the flag memory 112 is "0", and therefore the latch 18 is maintained reset. Accordingly, the output of the NAND gate 20 is "1", and the printing data code for the 7th column from the PLB 11 is compared with the type code in the comparator 15. When the two codes are coincident with each other, the signal HAMSET is set to "0", and the 7th column print hammer is driven. However, if the printing data code does not coincide with the type code, then the 7th column print hammer is not driven, and the 7th column of the flag memory 112 is maintained at "0".

In driving the 3rd column print hammer in the sub-scan 3 of the same main scan, first the 1st column of the flag memory 112 is "1", and therefore the latch 17 is set, and the output of the latch 17 is set to "1". Next, the 5th column of the flag memory 112 is also "1", therefore, the latch 18 is set, and the output of the latch 18 is set to "1".

Accordingly, the output of the NAND gate 20 is "0". Thereafter, the printing data code for the 3rd column from the PLB 11 is compared with the type data. It is assumed that as a result of the comparison the two data are coincident with each other. In this case, the output of the NAND gate 20 is "0" as described above, and accordingly the signal HAMSET is not set to "0". Therefore, the 3rd column print hammer is not driven. That is, driving the 3rd column print hammer is postponed until the next coincidence of the data occurs.

Signals g and h applied from the scan controller 13 to AND gates 16 and 16 respectively are timing signals. More specifically, in exciting the print magnet 2 of each column, the timing signals are employed to specify the information in the flag memory with respect to the −2nd and +2nd columns adjacent to the each column.

This embodiment of the invention has been described with reference to the band printer. In the case of a drum printer, the magnetic interference of the adjacent print magnets 2 ca be prevented according to the invention. In a drum printer, all of the columns are scanned by one scanning operation to perform one memory scanning in one main scan. In this case, the flag bits of the (N−2)-th and (N−2)-th columns are checked before the N-th column print hammer is driven. If the print hammers of the two adjacent columns are driven, driving the N-th column print hammer is inhibited.

When the memory scan of each main scan is started, the PLB counter 12 specifies the -1st column (which does not exist and is a phantom column). Although the output of the PLB 11 for this column is ineffective, it carries out the scan. Thereafter, four count-up clock pulses are provided by the scan controller 13, the content of the PLB counter 12 is increased by four counts, and the 3rd column is specified. If the 3rd column of the flag memory 112 is "1", then the latch 18 is set, whereas if it is "0", then the latch 18 is maintained reset. Thereafter, two count-down clock pulses are produced by the scan controller 13. As a result, the content of the PLB counter 12 is decreased by two counts, and the 1st column is specified. In the case of driving the 1st column print hammer, the latch 17 is maintained reset, and therefore the output of the NAND gate 20 is "1". When the printing data code is coincident with the type code for the 1st column, then the 1st column print hammer is driven.

Then, one count-down clock pulse is provided by the scan controller 13, the content of the PLB counter 12 is decreased by one count, and the 0-th column (which does not exist and is a phantom column) is specified. In this operation, the latches 17 and 18 are reset. The output of the PLB 11 for the 0-th column is ineffective, but carries out the scanning. Thereafter, four count-up clock pulses are provided by the scan controller 13. As a result, the content of the PLB counter 12 is increased by four counts and the 4th column is specified. When the 4th column of the flag memory 112 is "1", then the latch 18 is set, whereas if it is "0", then the latch 18 is maintained reset. Then, two count-down pulses are outputted by the scan controller 13, so that the content of the PLB counter 12 is decreased by two counts, and the 2nd column is specified. In driving the 2nd column print hammer, the latch 17 is maintained reset, and therefore the output of the NAND gate 20 is "1". Therefore, if the printing data code and the type code for the 2nd column are coincident with each other, then the 2nd column print hammer is driven.

Thereafter, one count-down clock pulse is provided by the scan controller, the content of the PLB counter 12 is decreased by one count, and the 1st column is specified. In this operation, the latches 17 and 18 are reset.

If the 1st column of the flag memory 112 is "1", then the latch 17 is set, and if it is "0", then the latch 17 is maintained reset. Thereafter, the scan controller 13 provides four count-up clock pulses, the content of the PLB counter 12 is increased by four counts, and the 5th column is specified. When the 5th column of the flag memory 112 is "1", then the latch 18 is set, and when it is "0", then the latch 18 is maintained reset. Then, the scan controller 13 outputs two count-down clock pulses, so that the content of the PLB counter 12 is decreased by two counts, and the 3rd column is specified. In the case of driving the 3rd column print hammer, when both the 1st and 5th columns of the flag memory 112 are "1" and the output of the NAND gate 20 is "0", the signal HAMSET is not set to "0". This happens even if the printing data code coincides with the type code and the output of the comparator 15 is therefore "1". That is, in this case, the 3rd column print magnet 2 is not excited.

Succeedingly, the scan controller 13 outputs one count-down clock pulse. Hence the content of the PLB counter 12 is decreased by one count, and the 2nd column is specified.

Thereafter, the flag bits of the −2nd and +2nd columns from the column of a print hammer to be driven are checked. When both of the columns are "1", the latches 17 and 18 are set, and the output of the NAND gate 20 is set to "0". Even if the printing data code coincides with the type code, driving of the print hammer for the column is inhibited.

Figure 4:
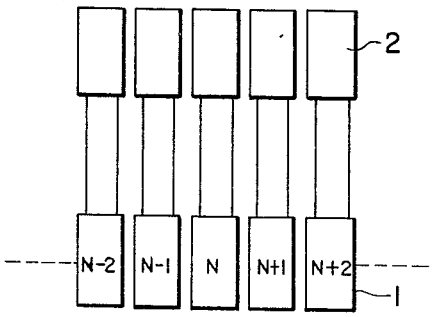
FIG. 4 is a front view showing another example of the arrangement of print hammer striking surfaces and print magnets.

In the above-described embodiment, the adjacent print magnets occur every two columns; however, it should be noted that the invention is not limited thereto or thereby. For instance, in a printing device in which the print magnets 2 are disposed adjacent to one another as shown in FIG. 4, before the N-th column print hammer is driven, the flag bits of the (N−1)-th and (N+1)-th columns are checked, and when both are "1", driving the N-th column print hammer is inhibited.

A second preferred embodiment invention will be described with reference to FIGS. 5–8.

Figure 5:
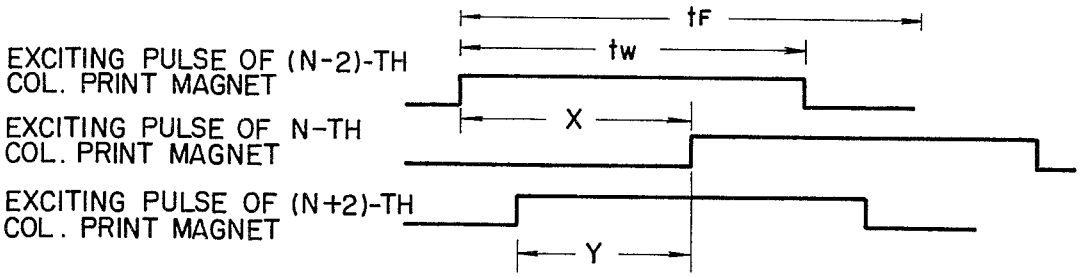
FIG. 5 is a timing diagram indicating the excitation of the print magnets.
Figure 6:
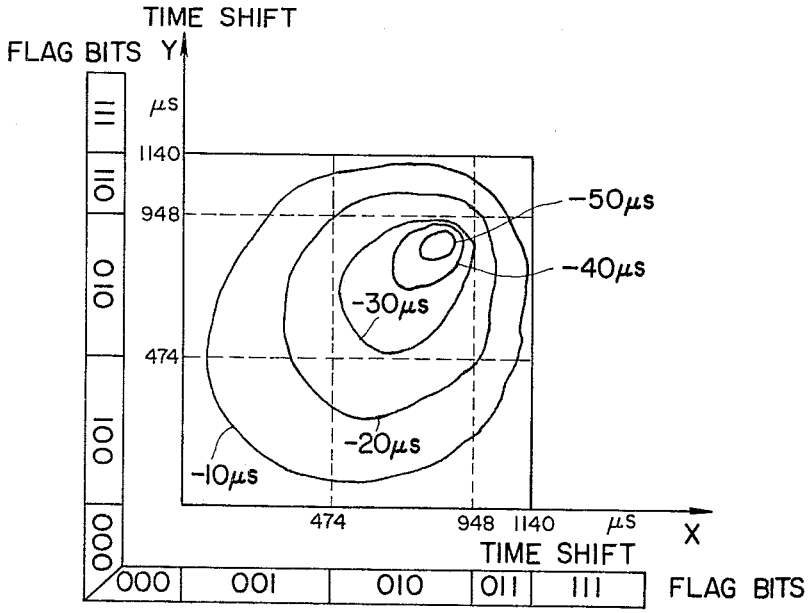
FIG. 6 is a characteristic diagram indicating flight time shifts due to magnetic interference.

FIG. 5 is an excitement timing diagram of the print magnet 2 shown in FIG. 1. FIG. 6 is a characteristic diagram indicating the change of flight time due to the magnetic interference. If the N-th column print magnet 2 is excited X time and Y time respectively after the excitement of the (N−2)-th column and (N+2)-th column print magnets, then the change in flight time of the N-th column print hammer is as indicated in FIG. 6 because of the change of the X time and Y time, i.e. the change of the N-th column print magnet's excitation timing. In FIG. 5, reference character $t_w$ designates the pulse width of the print magnet 2 which is for instance 1140 μs, and reference character $t_f$ designates the flight time of the print hammer which is for instance 1350 μs.

If it is assumed that the movement speed of the type carrier is 6.7 m/s, then the printing shifts corresponding to the flight time shifts 10 μs, 20 μs, 30 μs, 40 μs and 50 μs are 0.067 mm, 0.134 mm, 0.201 mm, 0.268 mm and 0.335 mm, respectively. Accordingly, in order to accept a printing shift less than 0.2 mm and to prevent the occurrence of a printing shift more than 0.2 mm, the excitation of the N-th column print magnet 2 should be inhibited only when the aforementioned X time and Y time, i.e. both of the excitement lapse time of the adjacent print magnets on both sides of the N-th column print magnet 2 are in the range of from about 474 μs to about 948 μs.

Before a method of monitoring the excitement lapse times of the print magnets 2 is described with respect to this embodiment it is appropriate to review the operation of a band printer having 132 columns per line in which five sub-scans are carried out in one print scan operation, i.e. whenever the types of a type carrier running horizontally is moved by one type pitch. This embodiment uses the technique of dividing into various cycle periods.

The exciting pulse widths of the print magnets of all of the columns can be collectively controlled by employing a method in which, in the sub-scan, the comparison period of a column is divided into the first half period (hereinafter referred to as "the reset cycle") and the second half period (hereinafter referred to as "the set cycle"), and in the reset cycle the excitement ending timing of each column is controlled while in the set cycle the excitation starting timing of the print magnet 2 of each column is controlled. Listed below are the columns for which the comparison is carried out in the sub-scans. Numerals in the parentheses ( ) designate the numbers of columns which are read out in the reset cycle, and numerals outside the parentheses ( ) designate the numbers of columns which are read out in the set cycle. All the columns are regularly and sequentially read out.

| | | |
|---|---|---|
| Print scan | Sub-scan 1; | 1(4), 6(9), 11(14),..... 126(129), 131(X) |
| | Sub-scan 2; | 2(5), 7(10), 12(15),..... 127(130), 132(X) |
| | Sub-scan 3; | 3(1), 8(6), 13(11),..... 128(126), X(131) |
| | Sub-scan 4; | 4(2), 9(7), 14(12),..... 129(127), X(132) |
| | Sub-scan 5; | 5(3), 19(8), 15(13),..... 130(128), X(X) |

The above-described exciting pulse width collective control can be achieved by adding at least three flag bits to a printing data code transferred from a data source. The flag bits correspond to the respective printing data codes.

First, if when a printing data code is transferred from the data source, data to be printed are available for the column, then flag bits (000) are added to the printing data code. If not, then flag bits (111) are added to the printing data code. Thereafter, in the printing operation, the printing data code is compared with the type code in the set cycle of each sub-scan. If both of the codes are coincident with each other, the print magnet 2 of the column is excited, while the flag bits (000) of the column is changed to the flag bits (001). The flag bits of the column the print magnet 2 for which has been excited are changed from (001) to (010) when read out in the set cycle of the respective sub-scan in the next print scan. The flag bits are changed from (010) to (011) when read out again in the next print scan. In the reset cycle of each sub-scan, if the flag bits of a column read out are (011), then the excitement of the column is ended, and the flag bits are changed from (011) to (111). In the reset cycle, if the flag bits are not (011), then the operation is not carried out.

Figure 8:
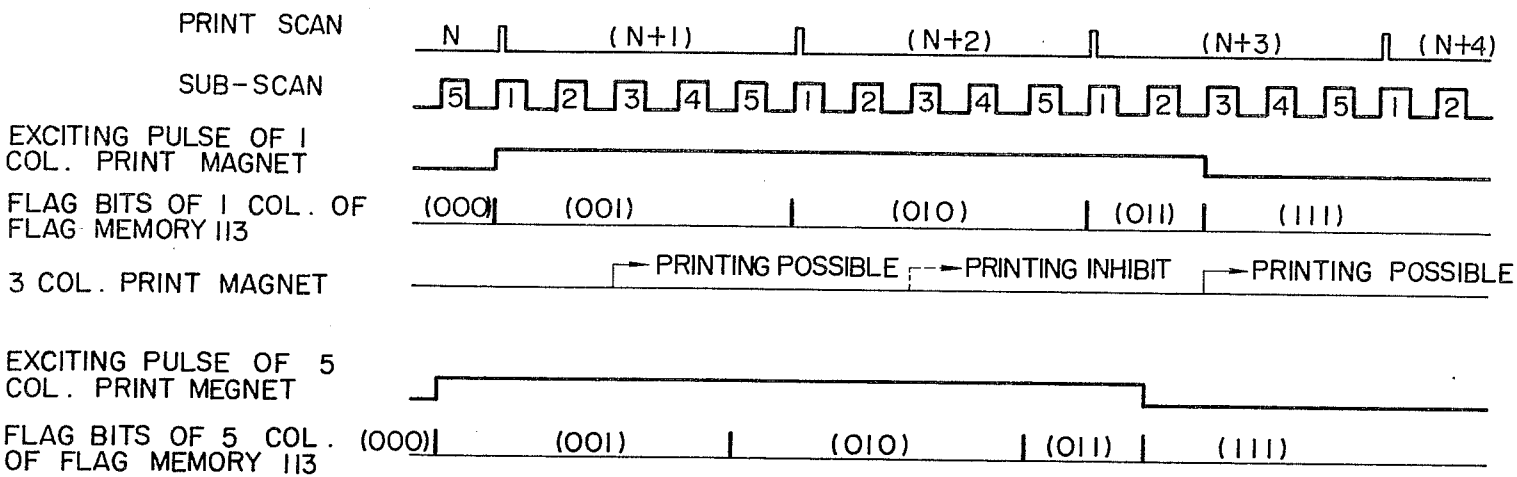
FIG. 8 is a timing diagram for a description of the operation of the device shown in FIG. 7.

This can be readily understood by reference to FIG. 8 which is a timing diagram indicating the excitation of the 1st, 3rd and 5th column print magnets 2. The excitation lapse time of each print magnet 2 can be detected by reading the flag bit data of the relevant column. If it is assumed that the period of each sub-scan is 95 μs, then the flag bits are (010) in the excitation lapse time of from 474 μs to 948 μs described above. Accordingly, in exciting the print magnet 2 of a column, the flag bits of columns corresponding to the adjacent print magnets on both sides of the firstly-mentioned print magnet are read out. If both of the flag bits are (010), then the excitation of the print magnet is inhibited. If they are not (010), then the excitement is started.

Figure 7:
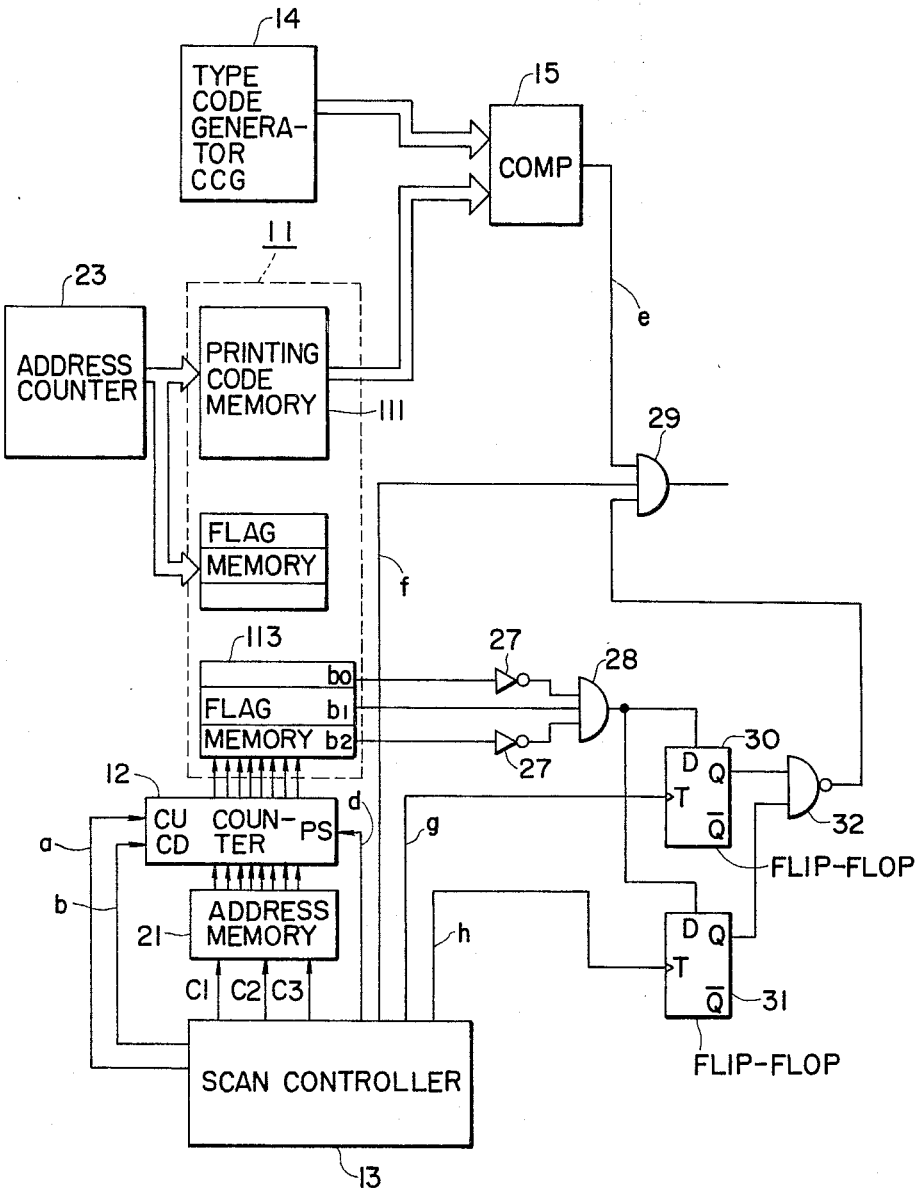
FIG. 7 is a diagram showing a second embodiment of the magnetic interference preventing device in a printing device according to this invention.

FIG. 7 is a block diagram showing a second embodiment of the device according to this invention. The same elements as in the first embodiment have been similarly numbered. A buffer memory 11 (hereinafter referred to as "a PLB 11") stores separately according to the columns the printing data codes for one line which are transferred from the above-described data source. The PLB 11 comprises: a printing code memory 111, and flag memories 112 and 113 for storing the above-described excitation lapse time information, i.e. the flag bits. The flag memory 112 is employed to control the exciting pulse width of the print magnet 2, while the other flag memory 113 is employed to control whether or not the excitation of the print magnet 2 should be started for the prevention of magnetic interference.

The addresses in the printing code memories 111 and the flag memory 112 are accessed in a predetermined sequence by an address controller 23 in the above-described sub-scan's set and reset cycles. Writing is effective for the flag memories 112 and 113 simultaneously in the sub-scan's set cycle as described above. However, the writing method and the method of accessing with the address controller 23 will not be described because the technical concept of controlling the exciting pulse width with the flag bits is well known in the art.

The printing data code from the PLB 11 is applied to a comparator 15, where it is compared with a type code which is applied to the comparator 15 from a type code generator 14 (hereinafter referred to as "a CCG 14") and corresponds to the print hammer of the relevant column. When both of the codes are coincident with each other, the comparator 15 outputs a coincidence signal e having "1".

The flag memory 113 is accessed by a PLB scan controller 13 with the aid of a PLB counter 12 and a PLB address memory 21 as described later.

Among the flag bits $b_0$, $b_1$ and $b_2$ of the flag memory 113, the flag bits $b_0$ and $b_2$ are applied through inverters 27 to an AND gate 28, and the flag bit $b_1$ is applied directly to the AND gate 28. When the flag bits are (010), the AND gate 28 provides an output having "1". The output "1" is applied to the "D" input terminals of D-type flip-flops 30 and 31. A timing signal g for designating the (N-2)-th column and a timing signal h for designating the (N+2)-th column are applied from the PLB scan controller 13 to the trigger input terminals T of the flip-flops 30 and 31, respectively, when the N-th column scanning is effected. The "Q" outputs of the flip-flops 30 and 31 are applied through a NAND gate 32 to one input terminal of an AND gate 29, to the remaining two input terminals of which the coincidence signal e from the comparator 15 and a fire timing signal f having "1" from the scan controller 13 are applied, respectively.

When all of these input signals are "1", the gate 29 is opened to apply a signal having "1" to a print magnet drive circuit (not shown). Accordingly, when both of the flag bits of the (N-2)-th and (N+2)-th columns are (010), both of the "Q" outputs of the flip-flops 30 and 31 are raised to "1", and the NAND gate 32 is opened. That is, the output of the NAND gate 32 is set to "0". Therefore, the AND gate 29 is not opened, so that the excitation of the print magnet is inhibited.

The operation of the device of the invention shown in FIG. 7 will be described. In the sub-scan 1, the column of the print magnet 2 which can be excited is the 1st column. The −1st column (which does not exist and is a phantom column) and the 3rd column are adajacent to the 1st column. Accordingly, the excitation lapse times for these adjacent columns should be detected. In starting the memory scanning of the sub-scan 1, the PLB address memory 21 specifies the top address −1st columns of the sub-scan 1 with the aid of a signal $C_1$, $C_2$, $C_3$ indicating the sub-scan number. The PLB counter 12 specifies the −1st column with the timing of a preset signal d from the scan controller 13. As a result, the flag bits in the flag memory 113, which corresponds to the −1st column, i.e. the excitation lapse time information having "0" is produced by the flip-flop 30 with the timing of the above-described timing signal g.

Then, the scan controller 13 outputs four count-up clock pulses a to increase the content of the PLB counter 12 by four counts. As a result, the 3rd column is specified. The excitation lapse time information having "0" corresponding to the 3rd column is produced by the flip-flop 31 with the timing of the aforementioned timing signal h.

Thereafter, two count-down clock pulses b are provided by the scan controller 13, the content of the PLB counter 12 is decreased by two counts, and the 1st column is specified. Simultaneously, in the printing code memory 111, the 1st column is accessed by the address controller 23, and the printing code thereof is applied to the comparator 15. When the printing code is coincident with the type code from the CCG 14, then the comparator 15 outputs the coincidence signal e having "1". The AND gate 29 is opened with the timing of the timing signal f to thereby start the excitation of the 1st column print magnet 2.

The 6th column can be excited next, and the 4th and 8th columns are adjacent to the 6th column. Therefore, the scan controller 13 successively produces three count-up clock pulses a, four count-up clock pulses a and two count-down clock pulses b to specify the 4th column, the 6th column and 8th column, respectively. The above-described operations are repeatedly carried out. Thereafter, as in the above-described case, the scan operation of the sub-scan 1 is carried out.

The excitation of the 3rd column print magnet in the sub-scan 3 will be described. In this connection, it is assumed that the excitations of the 1st and 5th print magnets adjacent to the 3rd column print magnet are as indicated in FIG. 8.

The PLB address memory 21 specifies the top address 1st column with the aid of the aforementioned signal $C_1$, $C_2$, $C_3$ designating the sub-scan number, and the PLB counter 12 specifies the 1st column with the timing of the preset signal d from the scan controller 13. The flag bits for the 1st column of the flag memory 113 are (001) in the (N+1)-th print scan, (010) in the (N+2)-th print scan, and (111) in the (N+3)-th print scan. Therefore, the "Q" output of the flip-flop 30 is set to "0" in the (N+1)-th print scan and in the (N+3)-th print scan, and it is set to "1" in the (N+2)-th print scan.

As in the above-described case, the PLB counter 12 next specifies the 5th column. Similar to the case of the 1st column, the flag bits for the 5th column in the flag memory 113 are (001), (010) and (111) respectively in the (N+1)-th, (N+2)-th and (N+3)-th print scans, and therefore the "Q" output of the flip-flop 31 is raised to "1" only in the (N+2)-th print scan. Accordingly, the start of excitation of the 3rd column print magnet 2 is inhibited only in the (N+2)-th print scan. However, it is allowed in the (N+1)-th and (N+3)-th print scans.

The above-described exciting pulse width and flight time are merely examples; that is, they can be changed as desired depending on the speed of the type carrier, etc. Furthermore, in the above-described embodiment, the start of excitation is inhibited in the case where both of the flag bits for the columns on the both sides are (010). However, the values of the flag bits can be changed if necessary.

As is apparent from the above description, according to the invention, the magnetic interference attributing to the leakage flux can be positively prevented. As a result, characters can be printed with high quality, and the size of the print hammer module, or the actuator module, can be reduced. Furthermore, according to the invention, even if the adjacent print magnets on both sides of a central print magnets are excited, the excitation of the central print magnet is not immediately inhibited. That is, the start of excitation thereof is inhibited only for the predetermined excitation lapse time during which the effect of the magnetic interference is significant. Accordingly, the number of times of inhibitions is reduced, which leads to the prevention of the lowering of the printing speed.

What is claimed is:

1. In a printing device having a plurality of print hammers whose striking surfaces are arranged along a print line, and print magnets provided adjacent one another for driving said print hammers when excited, the improvement comprising: a magnetic interference preventing system having memory means for storing for columns along said print line whether said print magnet for each column is being excited or not; detection means for reading out of said memory means, when the exciting of each print magnet is started, whether or not both print magnets adjacent to said each print magnet are being excited; and inhibiting means for inhibiting the exciting of said each print magnet between said both print magnets when said both print magnets are being excited.

2. The printing device of claim 1 wherein said memory means stores excitation lapse time data for said magnets in each column, and said detection means generates an output signal only when the excitation times of both print magnets are in a predetermined range of time.

3. The printing device of claims 1 or 2 wherein said memory means stores data for each print magnet along said print line.

4. The printing device of claims 1 or 2 wherein said memory means comprises a printing code memory and a flag memory.

5. The printing device of claim 4 further comprising a scan controller for generating counting pulses and a buffer memory receiving timing pulses and selectively transmitting them to said flag memory, and said detection means comprises logic means responsive to said scan controller and said flag memory.

6. The printing device of claim 5 further comprising a type code generator and a comparator for comparing the outputs of said type code generator and said printing code memory and providing one output to said inhibit means.

7. The printing device of claim 6 wherein said logic means comprises AND gate means responsive to said flag memory and said scan controller, a pair of latches selectively actuated by said AND gate means and a first NAND gate responsive to the condition of said latches.

8. The printing device of claim 7 wherein said inhibit means comprises a second NAND gate responsive to the output of said comparator and the output of said first NAND gate.

9. The printing device of claim 6 wherein said logic means comprises inverter means responsive to said flag memory, an AND gate responsive to said inverter means output, a pair of flip-flops, each responsive to the output of said AND gate and receiving separate second inputs from said scan controller, and a NAND gate receiving the outputs of said flip-flops.

10. The printing device of claim 9 wherein said inhibit means comprises an AND gate having a first input from said comparator and a second input from said NAND gate.

11. The printing device of claim 1 wherein said memory means comprises a printing code memory, a first flag memory to control an exciting pulse width of a print magnet, and a second flag memory to control whether or not said print magnet should be actuated for the prevention of magnetic interference.

12. The printing device of claim 11 further comprising an address controller to access said printing code memory and said first flag memory in a predetermined sequence.

13. The printing device of claim 11 further comprising a scan controller for accessing said second flag memory, and a buffer memory interposed between said second flag memory and said scan controller.

14. The printing device of claim 13 wherein said detection means comprises logic means responsive to said second flag memory, a pair of flip-flops, each flip-flop having a first input from said logic means and a second input from said scan controller, and a NAND gate responsive to the output of said flip-flops.

15. The printing device of claims 11 or 14 further comprising a type code generator and a comparator responsive to the outputs of said type code generator and said print code memory, the output of said comparator forming a first input to said inhibit means.

16. A printing device as defined in claim 1, wherein said inhibiting means permits the exciting of said each print magnet when only one of said both print magnets is being excited.

* * * * *